US008727113B2

(12) United States Patent
Robb et al.

(10) Patent No.: US 8,727,113 B2
(45) Date of Patent: May 20, 2014

(54) MULTIPLE SUBSTANCE MIXING CONTAINER SYSTEM

(76) Inventors: Hal P. Robb, Tucson, AZ (US); Harold G. Robb, Westlake Village, CA (US)

( * ) Notice: Subject to any disclaimer, the term of this patent is extended or adjusted under 35 U.S.C. 154(b) by 1271 days.

(21) Appl. No.: 11/457,052

(22) Filed: Jul. 12, 2006

(65) Prior Publication Data

US 2008/0011624 A1 Jan. 17, 2008

(51) Int. Cl.
*B65D 25/08* (2006.01)

(52) U.S. Cl.
USPC ..... 206/219; 220/521

(58) Field of Classification Search
USPC ..... 206/219, 220, 221, 568; 215/6; 220/521, 522
See application file for complete search history.

(56) References Cited

U.S. PATENT DOCUMENTS 2,663,450 A * 12/1953 Bourcart ..... 220/522
3,225,914 A * 12/1965 Klein et al. ..... 206/582
4,865,189 A * 9/1989 Guerra et al. ..... 206/221
5,409,128 A * 4/1995 Mitchell ..... 220/23.4
5,535,908 A * 7/1996 Sheu ..... 220/4.27
5,678,709 A * 10/1997 Holley et al. ..... 215/11.4
5,782,345 A * 7/1998 Guasch et al. ..... 206/222
5,950,689 A * 9/1999 Varlet ..... 141/22
6,681,958 B2 * 1/2004 Sorenson et al. ..... 222/145.1
6,945,416 B2 * 9/2005 Manno ..... 215/10
7,055,709 B1 * 6/2006 Esau ..... 215/228
2005/0184024 A1 * 8/2005 Santa Cruz et al. ..... 215/227

* cited by examiner

*Primary Examiner* — J. Gregory Pickett
*Assistant Examiner* — Blaine Neway
(74) *Attorney, Agent, or Firm* — Hayes Soloway P.C.

(57) ABSTRACT

A multiple substance mixing container system for permitting a consumer to customize a liquid within a container to their desired preference. The multiple substance mixing container system includes a mixing container including a first upper end, wherein the mixing container serves to hold a main ingredient and a vessel member including a first lower end and a second upper end. The first lower end of the vessel member attaches to the first upper end of the mixing container. The multiple substance mixing container system also includes an additive container for holding a mixing ingredient. The additive container fits within the vessel member and an upper cap is attachable to the second upper end of the vessel member.

19 Claims, 10 Drawing Sheets

MULTIPLE SUBSTANCE MIXING CONTAINER SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to containers and more specifically it relates to a multiple substance mixing container system for permitting a consumer to customize a liquid within a container to their desired preference.

2. Description of the Related Art

Any discussion of the prior art throughout the specification should in no way be considered as an admission that such prior art is widely known or forms part of common general knowledge in the field.

Containers have been in use for years. Typically, a container is used as a holding apparatus for a single substance (water, shampoo, etc.). Usually, if it is desired to add a second substance (e.g. hair conditioner) to a first substance (e.g. hair shampoo), the second substance must be stored in a second container until the two substances are ready to be mixed. In addition, the second substance may be pre-mixed with the first substance from the factory thereby preventing the consumer from adjusting the level of the second substance within the first substance (e.g. combination shampoo and conditioner).

Carrying two separate containers around with you or storing two separate containers can be a hassle. It is generally desired when traveling to bring only what is necessary. If you have a mixing solution for a particular substance and do not want to mix it right away, it may be difficult to carry separate containers for each individual substance. Also, it may be difficult to add additives to some containers because of narrow openings in the container.

While these devices may be suitable for the particular purpose to which they address, they are not as suitable for permitting a consumer to customize a liquid within a container to their desired preference. Carrying separate containers for each substance can lead to unnecessary work, cost and an overall more difficulty in transporting substances. In addition, substances premixed from the factory do not allow the consumer to adjust the relative levels of the substances.

In these respects, the multiple substance mixing container system according to the present invention substantially departs from the conventional concepts and designs of the prior art, and in so doing provides an apparatus primarily developed for the purpose of permitting a consumer to customize a liquid within a container to their desired preference.

BRIEF SUMMARY OF THE INVENTION

In view of the foregoing disadvantages inherent in the known types of containers now present in the prior art, the present invention provides a new multiple substance mixing container system construction wherein the same can be utilized for permitting a consumer to customize a liquid within a container to their desired preference.

The general purpose of the present invention, which will be described subsequently in greater detail, is to provide a new multiple substance mixing container system that has many of the advantages of the mixing containers mentioned heretofore and many novel features that result in a new multiple substance mixing container system which is not anticipated, rendered obvious, suggested, or even implied by any of the prior art containers, either alone or in any combination thereof.

To attain this, the present invention generally comprises a mixing container including a first upper end, wherein the mixing container serves to hold a main ingredient and a vessel member including a first lower end and a second upper end. The first lower end of the vessel member attaches to the first upper end of the mixing container. The multiple substance mixing container system also includes an additive container for holding a mixing ingredient. The additive container fits within the vessel member and an upper cap is attachable to the second upper end of the vessel member.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a multiple substance mixing container system that will overcome the shortcomings of the prior art devices.

A second object is to provide a multiple substance mixing container system for permitting a consumer to customize a liquid within a container to their desired preference.

Another object is to provide a multiple substance mixing container system that includes two separate reservoir systems.

An additional object is to provide a multiple substance mixing container system where the additive substance containers are stackable for providing convenient storage.

A further object is to provide a multiple substance mixing container system that includes a transparent vessel to see how much additive substance is available without removing the second container from the first container.

Another object is to provide a multiple substance mixing container system that overcomes the problems of pre-mixed liquids.

Another object is to provide a multiple substance mixing container system that may be attached to various types of containers including but not limited to plastic bottles, glass bottles and the like.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
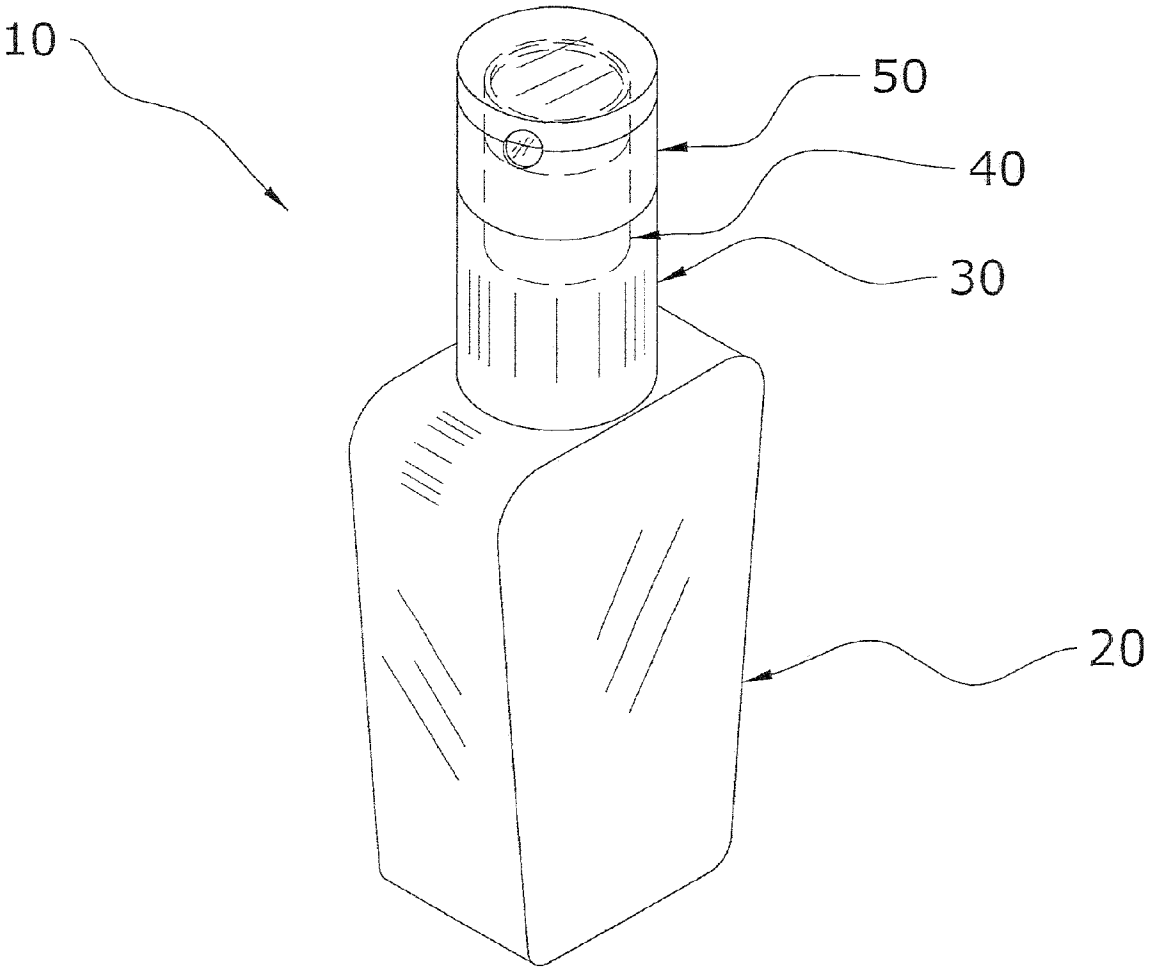
FIG. 1 is an upper perspective view of the present invention.

Turning now descriptively to the drawings, in which similar reference characters denote similar elements throughout the several views, FIGS. 1 through 10 illustrate a multiple substance mixing container system 10, which comprises a mixing container 20 including a first upper end 22, wherein the mixing container 20 serves to hold a main ingredient and a vessel member 30 including a first lower end 34 and a second upper end 36. The first lower end 34 of the vessel member 30 attaches to the first upper end 22 of the mixing container 20. The multiple substance mixing container system 10 also includes an additive container 40 for holding a mixing ingredient. The additive container 40 fits within the vessel member 30 and an upper cap 50 is attachable to the second upper end 36 of the vessel member 30.

B. Mixing Container

The mixing container 20 is comprised of a structure and configuration to hold a liquid substance. The mixing container 20 is preferably of a structure of a conventional bottle as illustrated in FIGS. 1 through 7. The mixing container 20 is also preferably comprised of a plastic material however various other materials may utilized to construct the mixing container 20. The first upper end 22 of the mixing container 20 preferably extends upward to form a neck structure and configuration. It can be appreciated that the mixing container 20 may be constructed of various shapes, sizes and structures other than illustrated. The mixing container 20 may also be an existing conventional container or a newly manufactured container produced in conjunction with the additive container.

Figure 3:
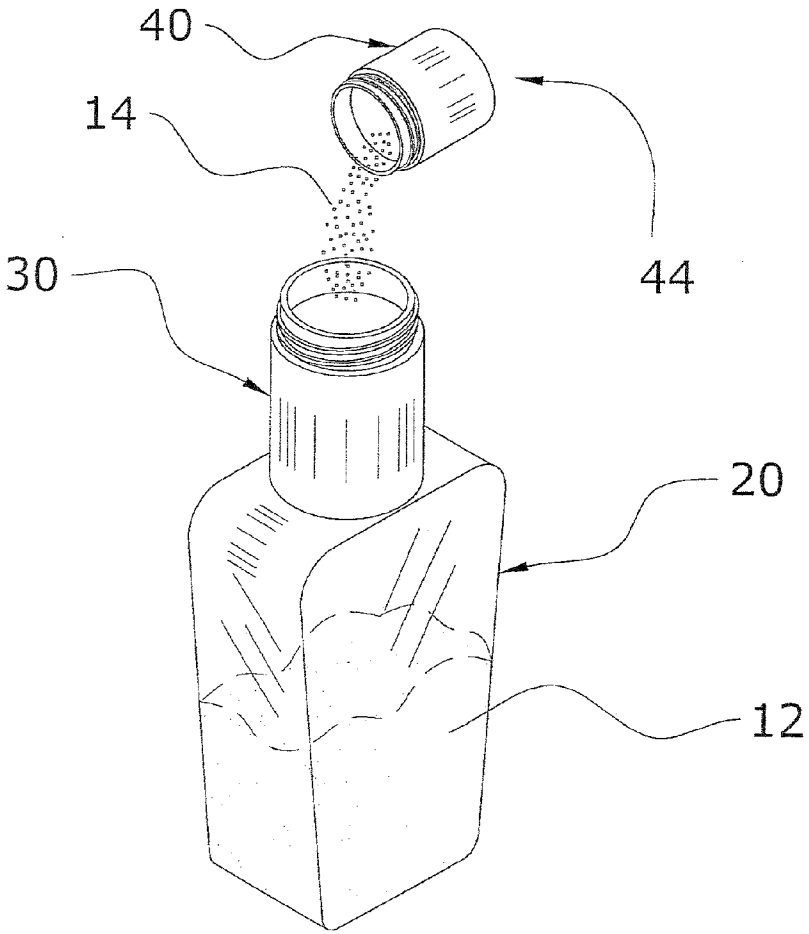
FIG. 3 is an upper perspective view of the present invention in use with a second substance from the second container being added to a first substance form the first container.
Figure 4:
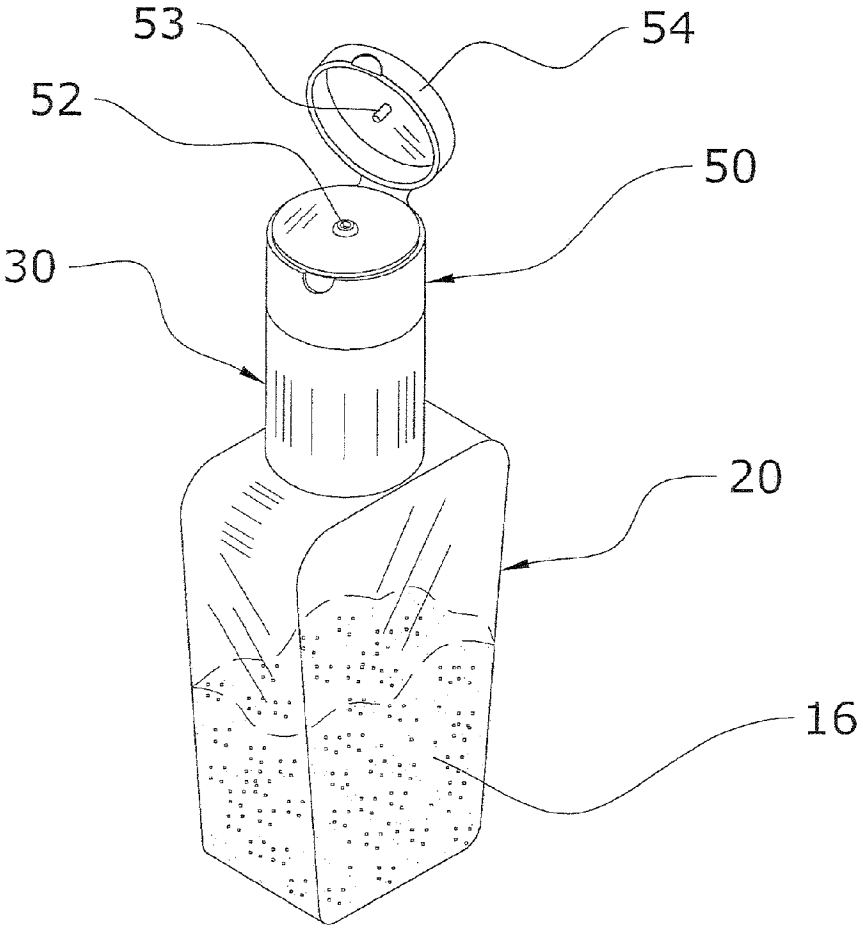
FIG. 4 is an upper perspective view of the present invention in use with a second substance from the second container mixed with a first substance from the first container.
Figure 5:
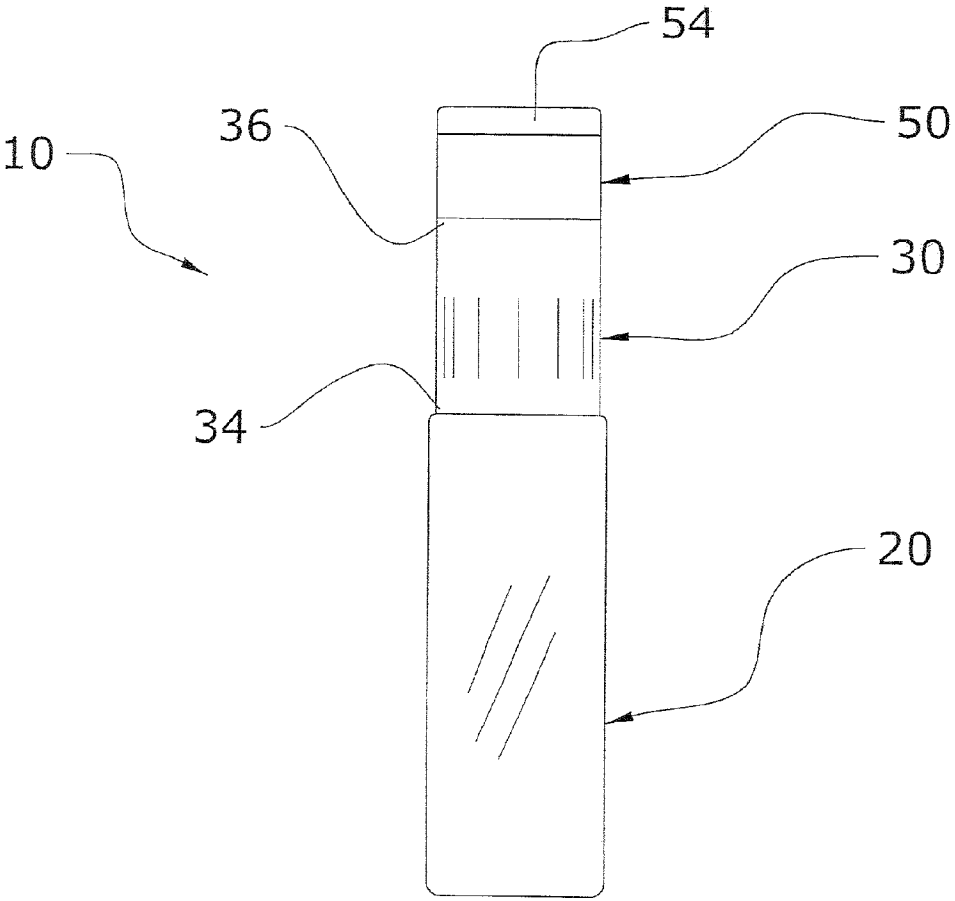
FIG. 5 is a side view of the present invention.
Figure 6:
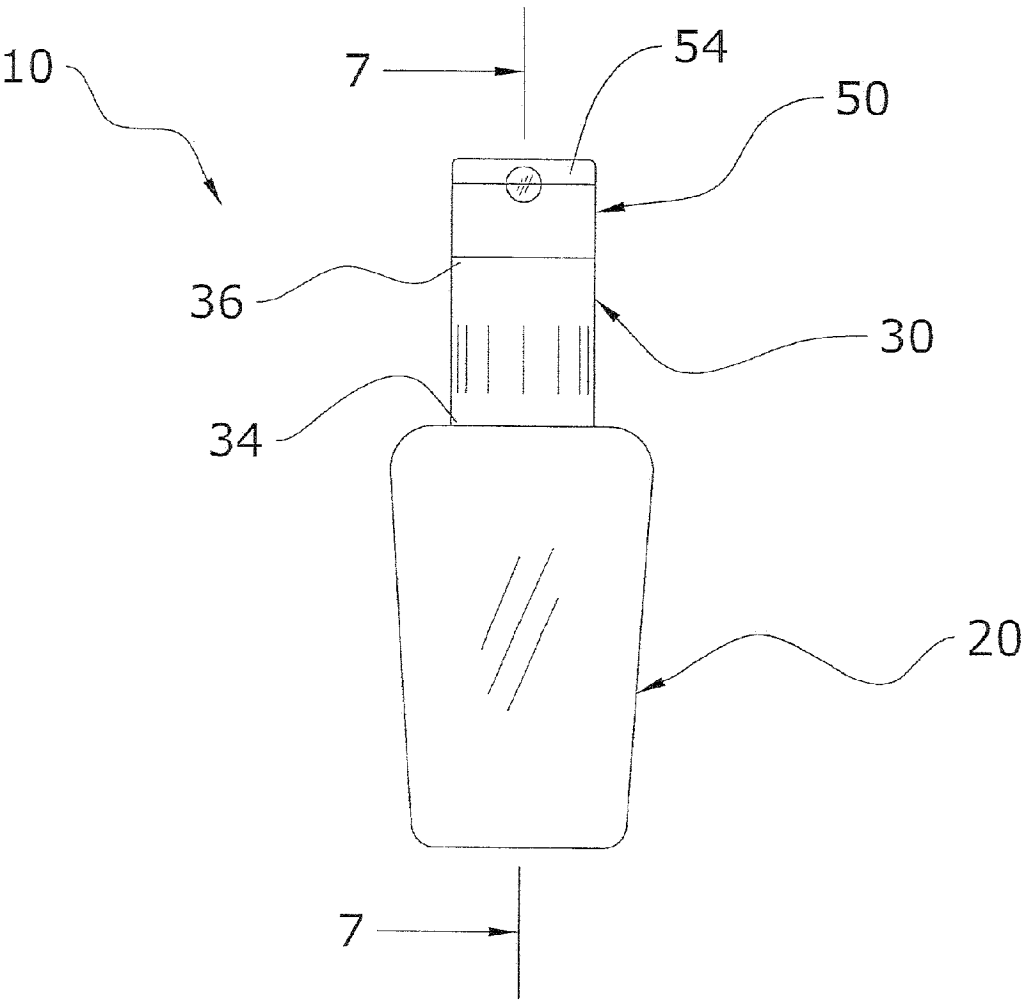
FIG. 6 is a front view of the present invention.

The first upper end 22 includes an opening for receiving and dispensing a first substance 12 as best illustrated in FIGS. 3 and 4. The first substance 12 is preferably comprised of a liquid substance (e.g. hair shampoo), however the first substance 12 may be comprised of a granular material, particulate material or other substance.

Figure 2:
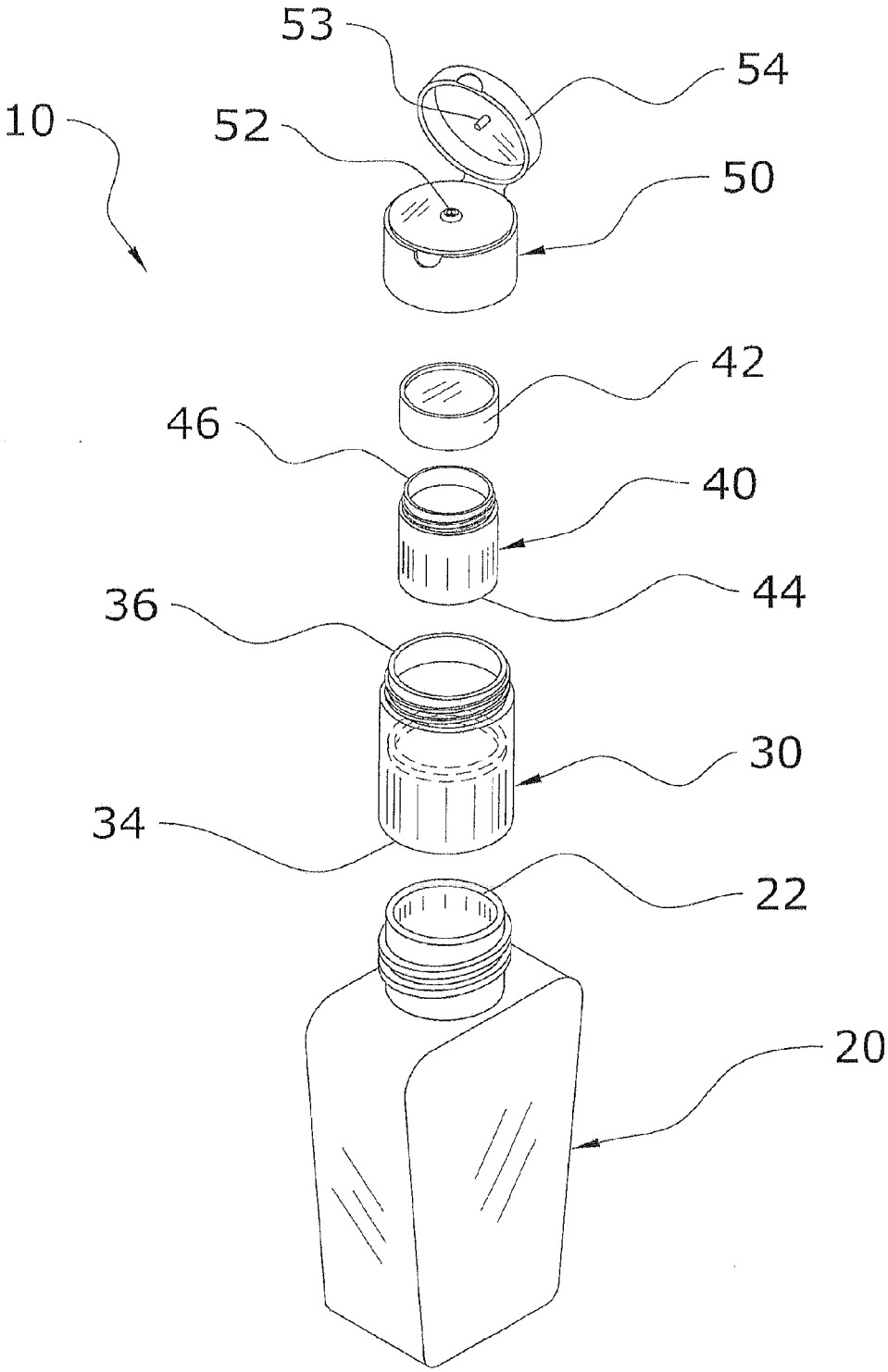
FIG. 2 is an exploded upper perspective view of the present invention.
Figure 7:
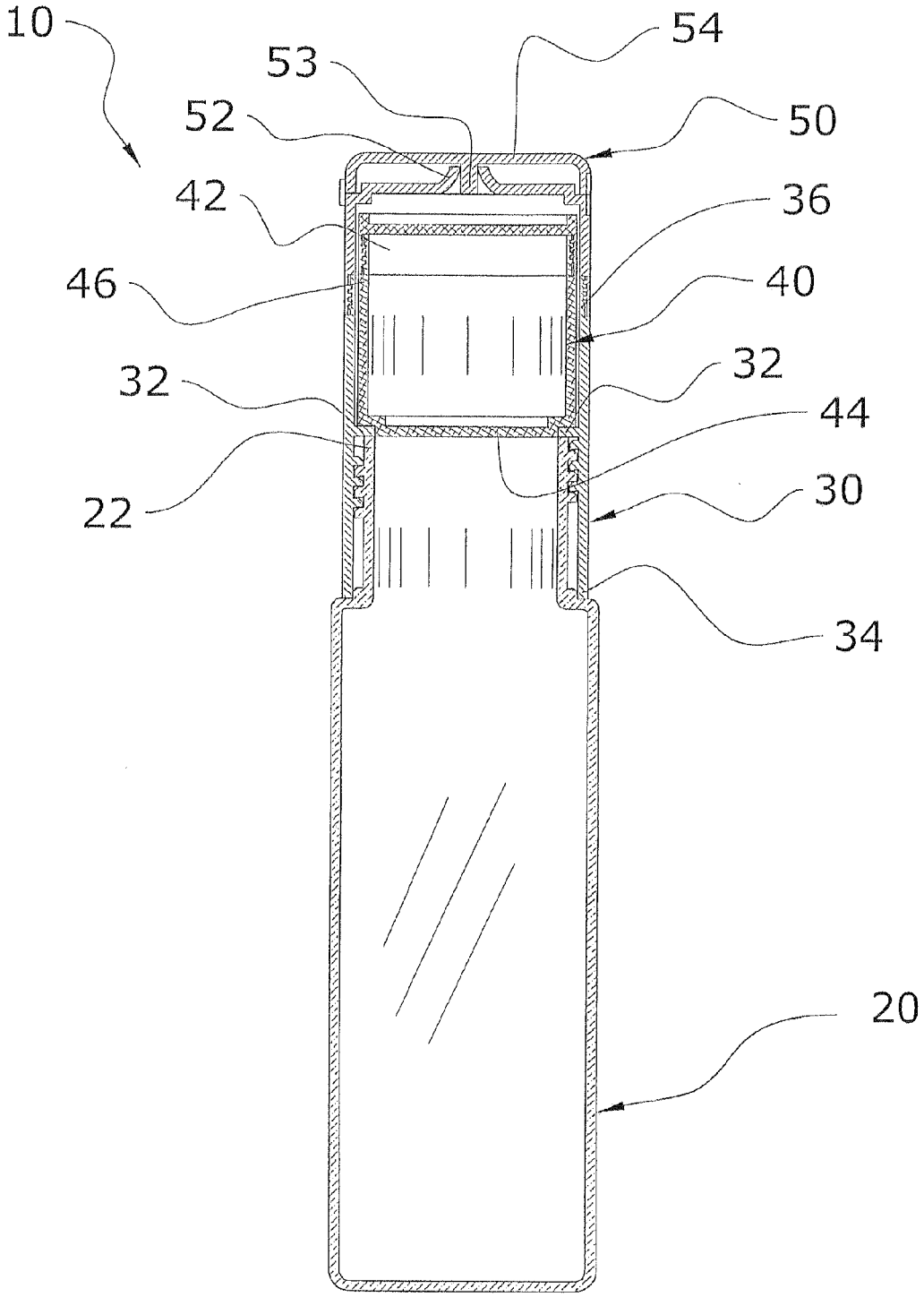
FIG. 7 is a sectional view of the present invention taken along lines 7-7 of FIG. 6.

The first upper end 22 of the mixing container 20 and the first lower end 34 of the vessel member 30 are preferably comprised of a threaded structure and configuration so as to be able to threadably connect to each other as illustrated in FIGS. 2 and 7. It is appreciated that other connecting structures may be utilized when connecting the vessel member 30 to the mixing container 20.

C. Vessel Member

The vessel member 30 is preferably comprised of a hollow and elongated circular structure as shown in FIGS. 1 through 4 and 7. The vessel member 30 is also preferably comprised of a plastic material however various other materials may be utilized. The vessel member 30 is also preferably substantially transparent to ensure proper mixing of the first substance 12 with a second substance 14, when pouring the second substance 14 into the mixing container 20 through the vessel member 30. The vessel member 30 is preferably a separate structure from the mixing container 20 to allow for attachment to various mixing containers 20, however the vessel member 30 may be comprised of an integrally formed structure with the mixing container 20.

The vessel member 30 preferably includes a stopper member 32. The stopper member 32 is preferably comprised of a circular ring structure and configuration as illustrated in FIG. 2. The outer diameter of the stopper member 32 is preferably substantially similar to the inner diameter of the vessel member 30 so that the stopper member 32 is able to fit within the vessel member 30. The stopper member 32 however is preferably integrally formed within the vessel member 30 as shown in FIG. 7 of the drawings. The inner diameter of the stopper member 32 is smaller than the outer diameter of the additive container 40 to support the additive container 40 within the vessel member 30. The stopper member 32 further provides a stop for the threading of the vessel member of the mixing container 20.

The stopper member 32 is preferably positioned at a distance away from the second upper end 36 equal or greater to the height of the additive container 40 as shown in FIGS. 2 and 7. This is to ensure that the additive container 40 is able to be secured inside the multiple substance mixing container system 10. In addition to the stopper member 32 serving as a base for the additive container 40, the stopper member 32 also serves to provide a frictional surface for the first substance 12 and the second substance 14 to efficiently mix against.

The second upper end 36 of the vessel member 30 and the upper cap 50 preferably include a threaded structure and configuration as to be able to threadably connect to each other. It is also appreciated that other connecting means may be utilized when connecting the vessel member 30 to the upper cap 50.

D. Additive Container

The additive container 40 is comprised of a structure and configuration to retain a substance (liquid or non-liquid) as illustrated in FIGS. 1 through 3 and 7. The second substance may be comprised of various types of materials (e.g. liquid hair conditioner, powdered flavoring, etc.). The additive container 40 preferably fits within the second upper end 36 of the vessel member 30 and rests on top of the stopper member 32. The additive container 40 is also preferably comprised of a plastic and transparent material, however various other materials may be utilized. The use of a transparent material with the additive container 40 helps the user view how much of the second substance 14 is left in the additive container 40 without disassembling the multiple substance mixing container system 10.

The additive container 40 also preferably includes an additive cap 42 as illustrated in FIGS. 1 through 3 and 7 through 9. The additive cap 42 seals the second substance 14 in the additive container 40. The additive cap 42 preferably threadably attaches to the third upper end 46 of the additive container 40.

Figure 8:
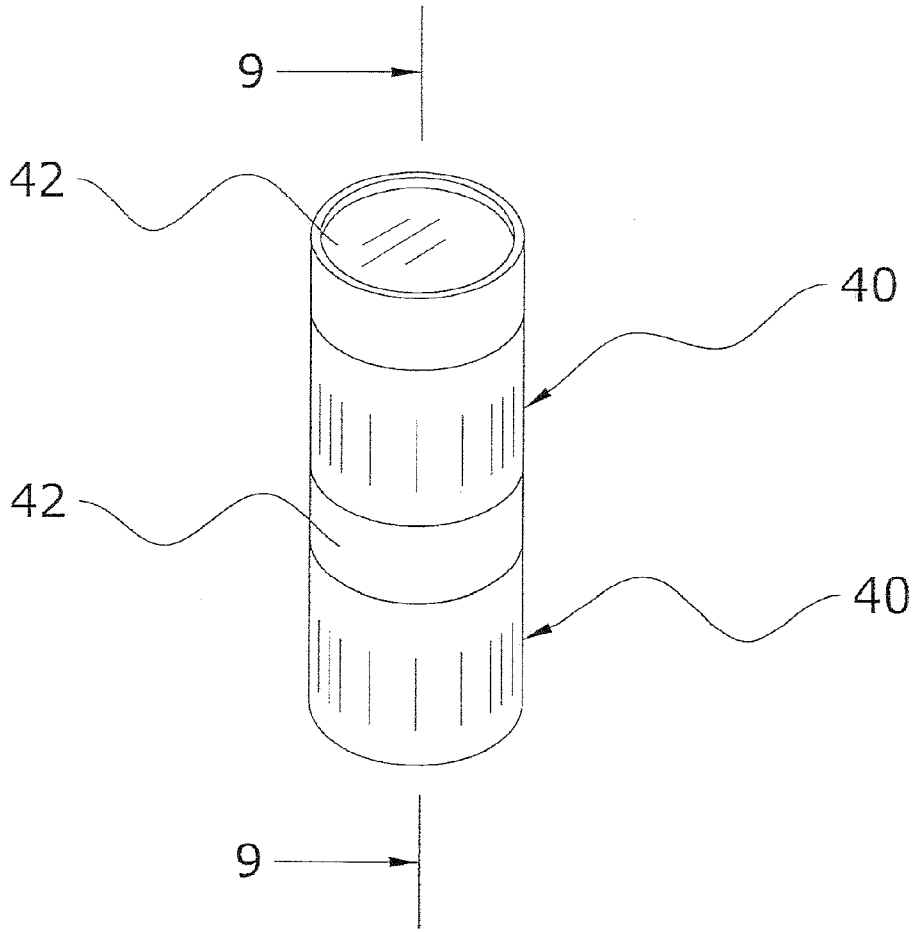
FIG. 8 is an upper perspective view of two additive containers stacked upon one another.
Figure 9:
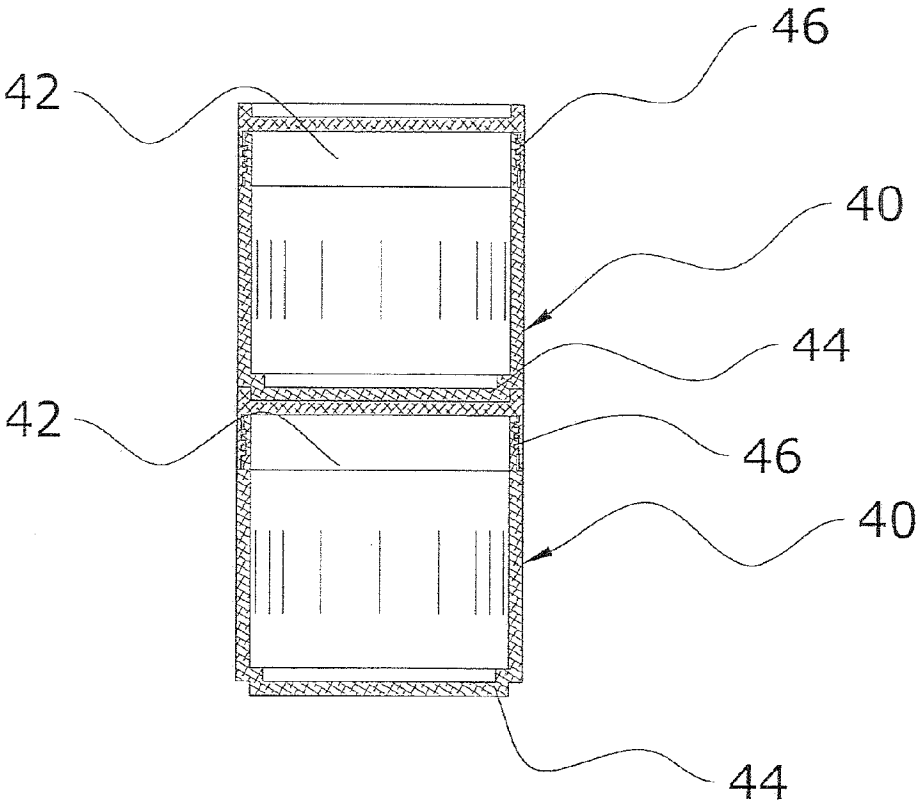
FIG. 9 is a sectional view taken along lines 9-9 of FIG. 8.
Figure 10:
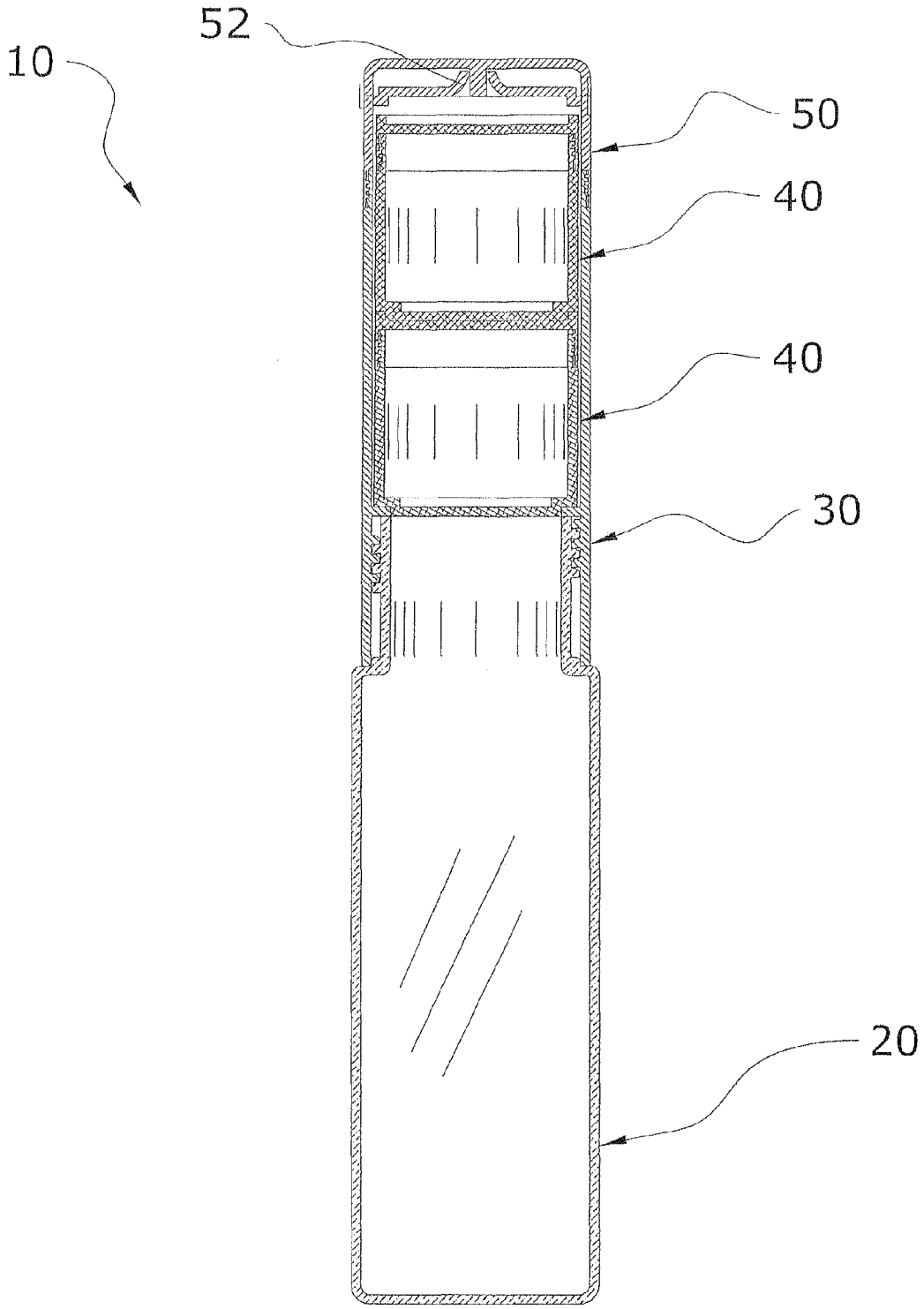
FIG. 10 is a side cross sectional view of the present invention illustrating multiple additive containers within the vessel member in a stacked manner.

The additive cap 42 also preferably includes a recessed portion at the top of the additive cap 42. The recessed portion preferably receives a protruding portion of a second lower end 44 of the additive container 40, as shown in FIGS. 8 and 9. The protruding portion of the second lower end 44 further preferably extends between the inner portion of the stopper member 32 to seal the first substance 12 away from the upper part of the additive container 40 during transportation and storage of the same. This allows multiple additive containers 40 to be stacked upon one another within the vessel member 30 thereby allowing additional volumes of the second substance 14 or additional substances to be included within the vessel member 30.

E. Upper Cap

The upper cap 50 is preferably comprised of a plastic material and is preferably threadably connected to the vessel member 30. The upper cap 50 includes an aperture 52 to allow a mixed substance 16 to be dispersed from the multiple substance mixing container system 10. The aperture 52 is preferably centrally located on the upper cap 50 as illustrated in FIGS. 2, 4 and 7.

The upper cap 50 also preferably includes a cover 54. The cover 54 is preferably attached to the upper cap 50 through a hinge structure and configuration as shown in FIGS. 2, 4 and 7. The cover 54 preferably includes a plug member 53. The plug member 53 secures the aperture 52 shut when the cover 54 is closed over the upper cap 50. This ensures that a substance can't leak from the upper cap 50 during nonuse.

F. In Use

In use, the upper cap 50 is threadably removed from the vessel member 30 and the additive container 40 is removed from the vessel member 30. The mixing container 20 may now be filled with a first substance 12 or main ingredient through the vessel member 30 (or directly by removing the vessel member 30). Once the mixing container 20 is filled to a desired height, the mixing container 20 and connected vessel member 30 are set aside.

The additive cap 42 is now removed from the additive container 40 and the additive container 40 is filled to a desired volume of the second substance 14. The additive cap 42 may now be replaced back on the additive container 40 and the additive container 40 is placed back in the vessel member 30 through the second upper end 36. The upper cap 50 is now replaced back on the second upper end 36 of the vessel member 30 while ensuring that the cover 54 is secure against the upper cap 50, as shown in FIG. 1.

When the first substance 12 and the second substance 14 are ready to be mixed the upper cap 50 is again removed from the vessel member 30 and the additive container 40 is removed from the vessel member 30. The additive cap 42 is then removed from the additive container 40 and the second substance 14 from the additive container 40 is poured into the vessel member 30 as illustrated in FIG. 3. The desired volume of the second substance 14 is added to achieve a desired mixture of the first substance 12 and the second substance 14. If multiple additive containers 40 are utilized, multiple additives may be added to the first substance 12 to achieve a desired mixture. The additive cap 42 may now be replaced back onto the additive container 40 and the additive container 40 may be placed aside for further filling or mixed together with an agitated action.

The upper cap 50 is now threadably connected to the vessel member 30 ensuring that the cover 54 is secure against the upper cap 50 as illustrated in FIG. 1. The mixing container 20 is now shaken thoroughly combining the first substance 12 with the second substance 14 to form a mixed substance 16. The cover 54 may now be unsecured from the upper cap 50, exposing the aperture 52 and allowing the mixed substance 16 to be dispensed from the mixing container 20 as illustrated in FIG. 4. When the mixed substance 16 is completely gone from the mixing container 20, the multiple substance mixing container system 10 may be taken apart and cleaned and then refilled with another substance or stored for later use.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

We claim:

1. A multiple substance mixing container system, comprising:

a mixing container having a first volume capacity for holding a main ingredient, said mixing container including a first upper end, wherein said mixing container is configured to retain a volume of a first mixing substance;

a vessel member including a first lower end and a second upper end, wherein said first lower end is removably attached to said first upper end of said mixing container;

an additive container having a second volume capacity smaller than said first volume capacity, to retain a volume of a second mixing substance, wherein said additive container includes a first cap, said additive container and first cap being removably positioned within said vessel member through said second upper end;

a stopper member formed integrally with and positioned on an inner side of said vessel member, said stopper member having a circular ring structure having an inner diameter smaller than an outer diameter of said additive container whereby to form a base for said additive container as well as a frictional surface for engaging the substances when the mixing container is agitated, wherein said stopper member is positioned within said vessel member to allow said additive container to reside completely within said vessel member; and a second cap removably attached to said second upper end of said vessel member;

and wherein said mixing container is configured to retain the combined volumes of the first and second mixing substances.

2. The multiple substance mixing container system of claim 1, wherein said vessel member is threadably attached to said first upper end of said mixing container.

3. The multiple substance mixing container system of claim 1, wherein said vessel member is comprised of a substantially transparent material.

4. The multiple substance mixing container system of claim 1, wherein said first cap is threadably attached to a third upper end of said additive container.

5. The multiple substance mixing container system of claim 1, wherein said first cap includes a recessed portion.

6. The multiple substance mixing container system of claim 5, wherein said additive container includes a second lower end, wherein said second lower end includes a protruded portion to fit within said recessed portion of said first cap and to sealably fit within said stopper member within said vessel member.

7. The multiple substance mixing container system of claim 1, wherein said additive container is comprised of a transparent material.

8. The multiple substance mixing container system of claim 1, wherein said second cap is threadably attachable to said second upper end of said vessel member.

9. The multiple substance mixing container system of claim 1, wherein said second cap includes an aperture to dispense a substance.

10. The multiple substance mixing container system of claim 1, wherein said vessel member is comprised of a circular cross sectional structure.

11. A multiple substance mixing container system, comprising:

a mixing container having a first volume capacity for holding a main ingredient, said mixing container including a first upper end, wherein said mixing container is configured to retain a volume of a first mixing substance;

a vessel member including a first lower end, a second upper end, a side wall, and a stopper member, wherein said first lower end is threadably attachable to said first upper end of said mixing container;

wherein said stopper member comprises a circular ring structure formed integrally on an inner side wall of said vessel member;

a first additive container having a volume capacity smaller than said first volume capacity, to retain a volume of a second mixing substance, wherein said first additive container is removably positioned within said vessel member through said second upper end;

a second additive container having a volume capacity smaller than said first volume capacity, to retain a volume of a third mixing substance, wherein said second additive container is removably positioned within said vessel member through said second upper end;

a first cap and a second cap removably attached to said first additive container and said second additive container respectively; and a third cap threadably attachable to said second upper end of said vessel member;

and wherein said mixing container is configured to retain the combined volumes of the first, second, and third mixing substances;

and wherein said stopper member has an inner diameter smaller than an outer diameter of either said additive containers whereby to form a base for either said additive containers as well as a frictional surface for engaging the substances when the mixing container is agitated, wherein said stopper member is positioned within said vessel member to allow said first additive container and said second additive container to reside completely within said vessel member.

12. The multiple substance mixing container system of claim 11, wherein said vessel member is comprised of a transparent material.

13. The multiple substance mixing container system of claim 11, wherein said first additive container and said second additive container are comprised of a transparent material.

14. The multiple substance mixing container system of claim 11, wherein said first cap and said second cap each include a recessed portion.

15. The multiple substance mixing container system of claim 14, wherein said additive containers each include a second lower end, wherein said second lower end includes a protruded portion to fit within said recessed portion of said first cap or said second cap and to sealably fit within said stopper member within said vessel member.

16. A multiple substance mixing container system, comprising:

a mixing container having a first volume capacity for holding a main ingredient, said mixing container including a first upper end, wherein said mixing container is configured to retain a volume of a first mixing substance;

a vessel member including a first lower end and a second upper end, wherein said first lower end is removably attached to said first upper end of said mixing container;

an additive container having a second volume capacity smaller than said first volume capacity, to retain a volume of a second mixing substance, wherein said additive container is removably positioned within said vessel member through said second upper end;

a first cap removably attached to said additive container, wherein said first cap is threadably attached to a third upper end of said additive container; and a second cap removably attached to said second upper end of said vessel member;

wherein said vessel member includes a stopper member positioned on an inner side of said vessel member;

wherein said stopper member is formed integrally with a side wall of said vessel member and is positioned within said vessel member to allow said additive container to reside completely within said vessel member, wherein said stopper member has a circular ring structure having an inner diameter smaller than the outer diameter of said additive container whereby to form a base for said additive container as well as a frictional surface for engaging the substances when the mixing container is agitated;

wherein said vessel member is threadably attached to said first upper end of said mixing container;

wherein said first cap of said additive container includes a recessed portion;

wherein said additive container includes a second lower end, wherein said second lower end includes a protruded portion to fit within said recessed portion of said first cap and to sealably fit within said stopper member within said vessel member;

wherein said second cap is threadably attachable to said second upper end of said vessel member;

wherein said second cap includes an aperture to dispense a substance; and wherein said vessel member is comprised of a circular cross sectional structure.

17. The multiple substance mixing container system of claim 1, wherein said mixing container includes a first volume of a main ingredient, and said additive container contains a second volume of an additive ingredient, smaller than said first volume of said main ingredient.

18. The multiple substance mixing container system of claim 1, wherein said mixing container contains a first volume of a main ingredient;

said first additive container contains a second volume, of a first additive ingredient, smaller than said first volume of said main ingredient; and said second additive container contains a second volume of a second additive ingredient, smaller than said first volume of said main ingredient.

19. The multiple substance mixing container system of claim 16, wherein said mixing container contains a first volume of a main ingredient, and said additive container contains a second volume of an additive ingredient, smaller than said first volume of said main ingredient.

* * * * *

UNITED STATES PATENT AND TRADEMARK OFFICE

CERTIFICATE OF CORRECTION

PATENT NO. : 8,727,113 B2
APPLICATION NO. : 11/457052
DATED : May 20, 2014
INVENTOR(S) : Robb et al.

It is certified that error appears in the above-identified patent and that said Letters Patent is hereby corrected as shown below:

In the Claims

Claim 18, Col. 8, line 57, "claim 1" should be --claim 11--.

Signed and Sealed this
Thirtieth Day of September, 2014

Michelle K. Lee

Michelle K. Lee
*Deputy Director of the United States Patent and Trademark Office*